US006105853A

United States Patent [19]

Lamare

[11] Patent Number: 6,105,853

[45] Date of Patent: Aug. 22, 2000

[54] EXTERIOR PACKAGING WITH INTEGRATED LATERAL HANDLE

[75] Inventor: Bertrand Lamare, Plobsheim, France

[73] Assignee: Folding Carton Partners, Fegersheim, France

[21] Appl. No.: 09/328,535

[22] Filed: Jun. 9, 1999

[30] Foreign Application Priority Data

Jun. 10, 1998 [FR] France ..... 98 07394

[51] Int. Cl.[7] ..... B65D 5/46

[52] U.S. Cl. ..... 229/117.12; 229/117.09; 493/59; 493/160; 493/909

[58] Field of Search ..... 229/117.09, 117.12, 229/117.13, 117.14, 117.23, 117.24; 206/427; 493/59–62, 160, 161, 909

[56] References Cited

U.S. PATENT DOCUMENTS

| | | | |
|---|---|---|---|
| 2,868,433 | 1/1959 | Anderson . | |
| 4,295,598 | 10/1981 | Calvert | 229/117.24 |
| 4,436,244 | 3/1984 | Morris | 229/117.12 |
| 4,498,619 | 2/1985 | Roccaforte . | |
| 4,860,944 | 8/1989 | Wonnacott | 229/117.13 |
| 5,072,876 | 12/1991 | Wilson | 206/427 |
| 5,395,044 | 3/1995 | Stout | 229/117.13 |

FOREIGN PATENT DOCUMENTS

| | | |
|---|---|---|
| 0 473 266 A1 | 3/1992 | European Pat. Off. . |
| 2 434 763 | 6/1981 | France . |

*Primary Examiner*—Gary E. Elkins
*Attorney, Agent, or Firm*—Davis and Bujold

[57] ABSTRACT

A parallelepiped cardboard package for a group of containers with a precut lateral handle integrated into one of the end surfaces of the package. The cardboard package is either pre-glued or wrapped around the contents formed from a flat sheet. The package consists of a base (2), lateral walls (4, 5), two end surfaces (6, 7) consisting of at least two panels folded over each other, and an upper surface (3) providing access to the bottles. The package comprises a handle that is integrated within the package body for grasping and carrying the package. The handle is lateral and integrated within one of the end surfaces. The handle is formed by the central portion of one of the closing panels of the end surface. The handle extremities consist of extensions of the adjacent lateral surfaces (4, 5) of the package body.

10 Claims, 6 Drawing Sheets

EXTERIOR PACKAGING WITH INTEGRATED LATERAL HANDLE

FIELD OF THE INVENTION

The present invention concerns a parallelepiped cardboard package for a group of containers with a precut lateral handle integrated into one of the end surfaces of the package.

The package according to the invention consists of a base, lateral walls, and two end surfaces closed by a succession of overlapping panels. One of the end surfaces has a lateral handle preformed in the extremity which is assembled at the time the package is picked up by the consumer.

BACKGROUND OF THE INVENTION

Numerous packages already exist in the art for holding a series of containers such as small bottles. These known packages originate as flat pieces cut from sheets of cardboard which are formed into packages surrounding the contents on assembly lines with mechanical devices. In these prior art packages and other similar packages, the handle is either integrated within the package body or joined to it.

There are also handles precut in the panels of the upper package surface which are assembled when the consumer picks up the package by first opening a flap and pushing it inside the package and then pressing with the thumb against an adjacent portion. A handle formed with this natural gripping motion provides the consumer with a means for grasping and carrying the package. However, because this handle is often of modest proportions on various small capacity packages, it is fairly uncomfortable to insert one's fingers into the small handle opening. Moreover, there is a risk of tearing the package, causing the bottles to fall out.

There are also handles joined to the package during manufacture or afterwards which offer a better hand grip. One such handle is generally made in the form of a perimeter cord wrapped around the contents of the container.

French Patent No. 2 434 763 relates to a package with such a handle formed of a loop of the cord surrounding the contents which extends outside the package. This horizontal belt forms a lateral handle after pressing on a rib or cross piece angled against the bottle. The material is strong in relation to the weight of the package so it does not break during transport. However, the package described in this patent has several disadvantages that are considered important from a consumer point of view.

These relate to techno-economic considerations and consumer comfort while carrying the package.

First, the packaging assembly line would have to include a station for positioning the loop and gradually tightening it, while still preventing it from crushing the compressible rib-like structures. In addition, this belt-like handle is made from a loop of material not readily adapted to this use. As a result, grasping such a package and holding it with the bare hand produce a persistent disagreeable and even painful sensation.

The goal of the present invention is to overcome the disadvantages enumerated above by proposing a package with an integrated lateral handle formed when it is grasped. The handle is easy to grip, comfortable to carry, and strong.

SUMMARY OF THE INVENTION

The parallelepiped package according to the invention consists of a base, an upper surface, two lateral walls, and two end surfaces, in at least one of which a lateral handle is formed when the package is grasped.

According to one essential feature of the invention, the handle, which is precut along with the sheet of material which will form the package, consists of a double thickness of cardboard: a first layer consisting of two tongues or strips formed in the extension of the lateral walls, and a second layer consisting of a precut band in one of the panels, of one of the end surfaces, of the package body.

The double layers of the package handle provide strength, while the wide design improves comfort.

According to another essential characteristic of the invention, the handle is completely integrated within one of the end surfaces while the package is stored, and it is not formed until the consumer picks the package up.

According to a third essential characteristic of the invention, the handle extends into slots in the lateral walls of the package allowing its extremities to contact the lateral wall adjacent to the corner bottles when it is being gripped, thus making it longer.

These slots free up enough space between the adjacent surface and the band forming the handle so that a hand can pass behind the handle and grip it comfortably.

BRIEF DESCRIPTION OF THE DRAWING(S)

The invention will be more readily understood with reference to the following description, based upon a preferred, non-limiting embodiment, and to the attached drawings, in which.

Figure 11:
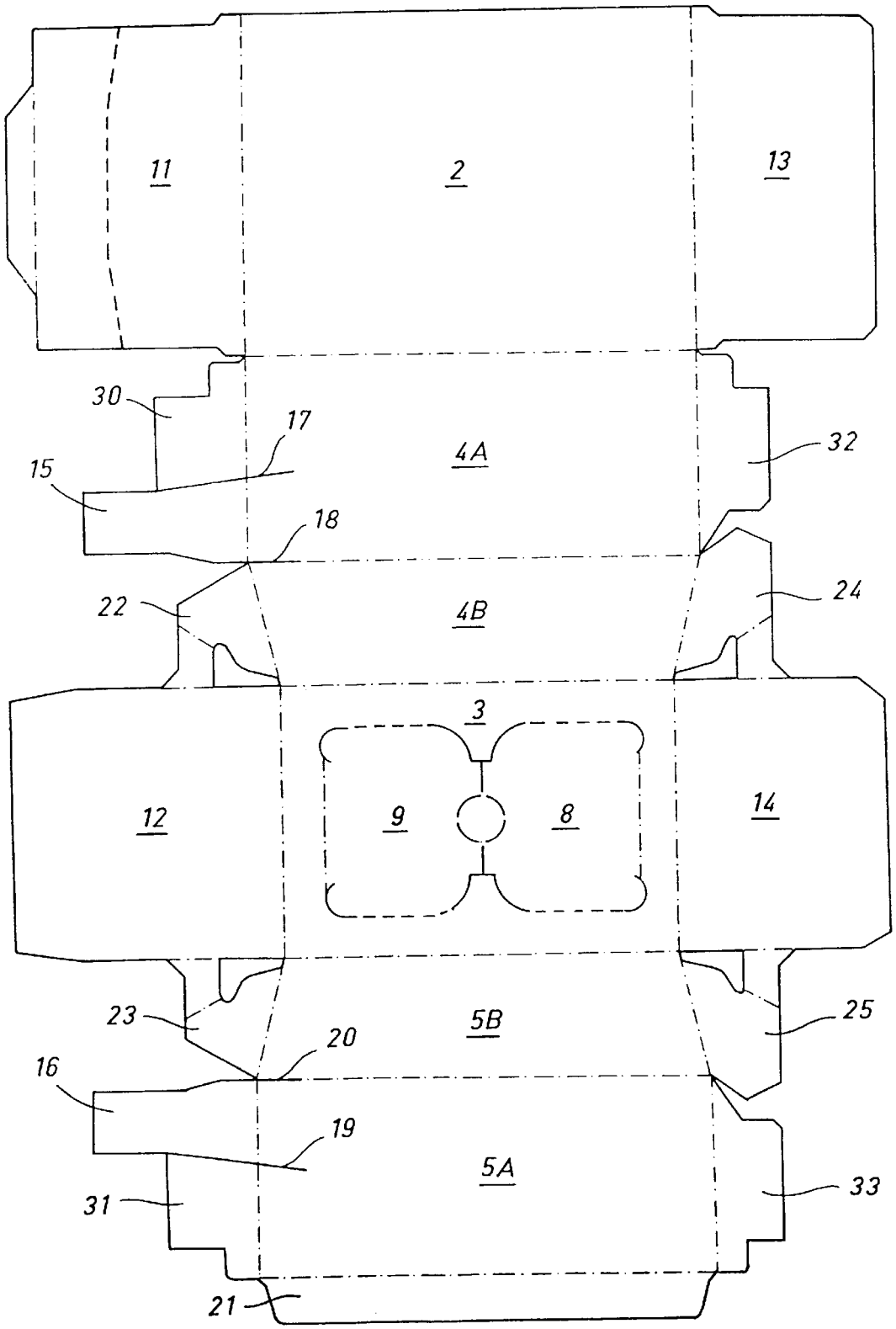

FIGS. 6 through 10 are perspectives, the first series (6 through 8) depicting formation of the handle in one of the end surfaces when the package is constructed, and the second series (9 and 10) depicting formation of the handle when the package is grasped and then carried by the handle thus formed;

FIG. 11 is a plan view of the cut sheet of material which forms the package according to the invention.

DESCRIPTION OF THE PREFERRED EMBODIMENT(S)

The present invention proceeds from a generally inventive principle according to which a lateral handle is integrated within one of the end surfaces of a package and assembled by pulling the central portion when the package is picked up. The handle is formed of two tongue-like strips extending from adjacent lateral surfaces, folded down against the end surface, covered by a detachable end band on one of the closing panels used to join the strips and reinforce them. The curve of the handle is made possible by recessed areas in the corner to the right of the handle extremities along each of two parallel slots. These recessed areas flatten the handle extremities when it is pulled against the lateral surface of the corner bottles inside the package.

Figure 1:
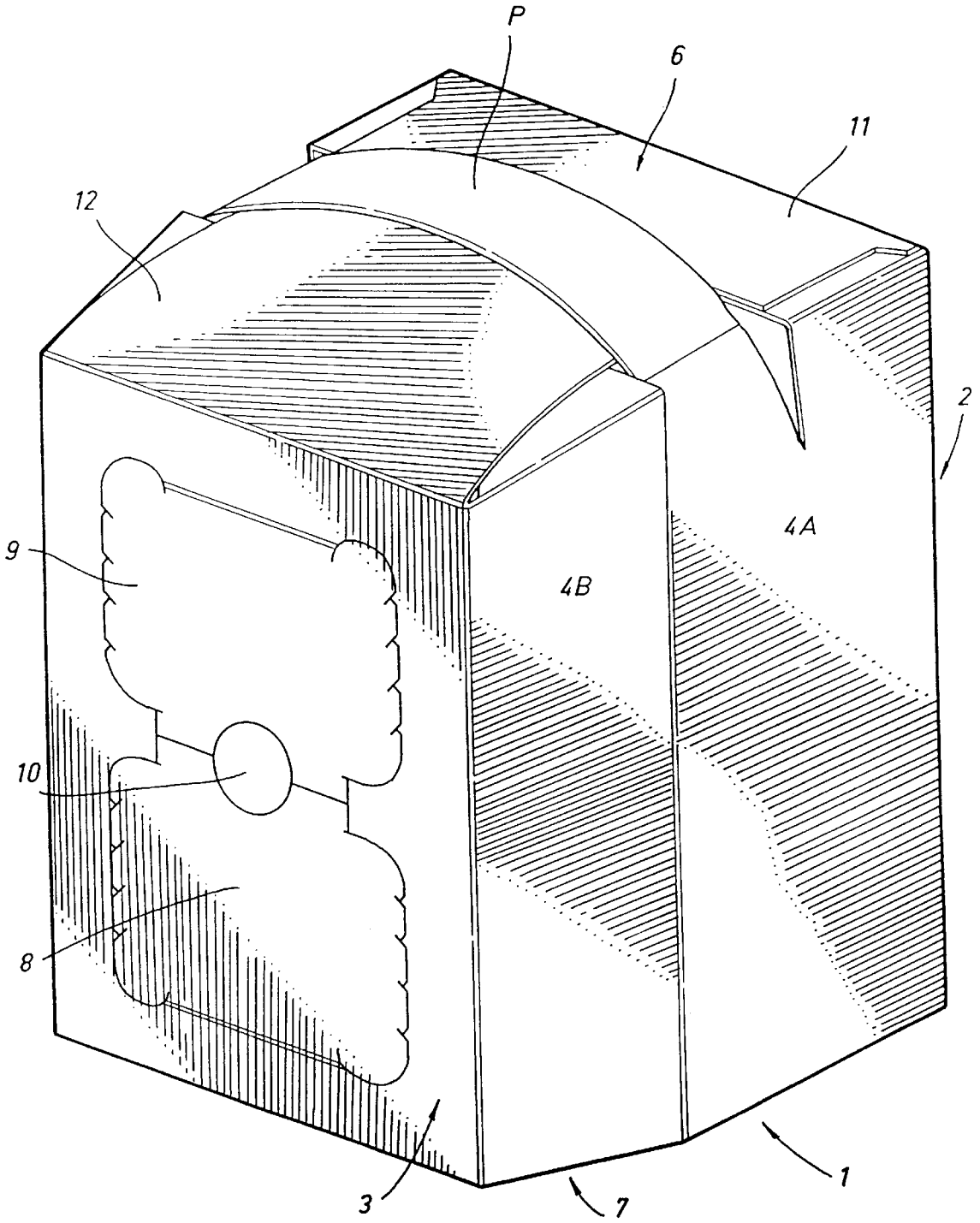
FIG. 1 is a perspective of the entire package according to the invention.

FIG. 1 shows a perspective of the package according to the invention designated by reference numeral 1. In this drawing there is a lateral handle P, formed by detaching it from the rear end portion of the package, which is large enough to offer a good grip, comfortable to carry, and easy to keep upright.

Figure 2:
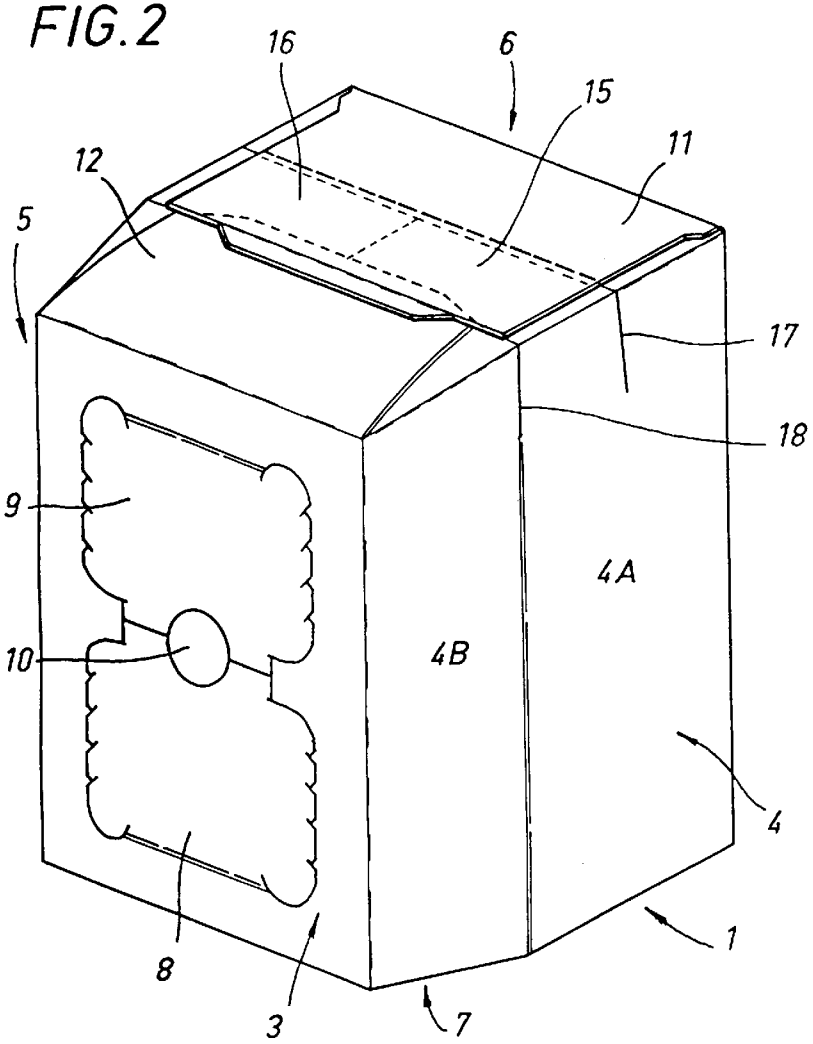
Figure 4:
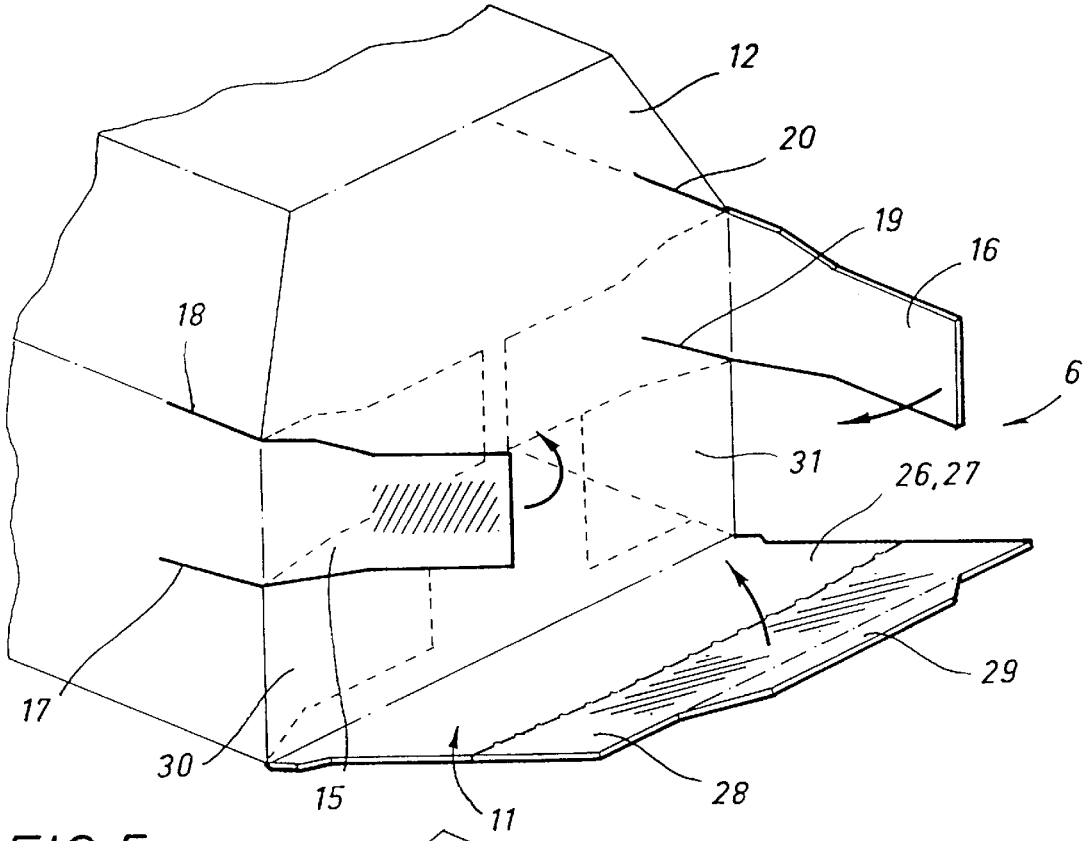
FIG. 4 is a simplified view of a detail of the extremity with the integrated handle, showing how the structures are folded out to form the handle.
Figure 5:
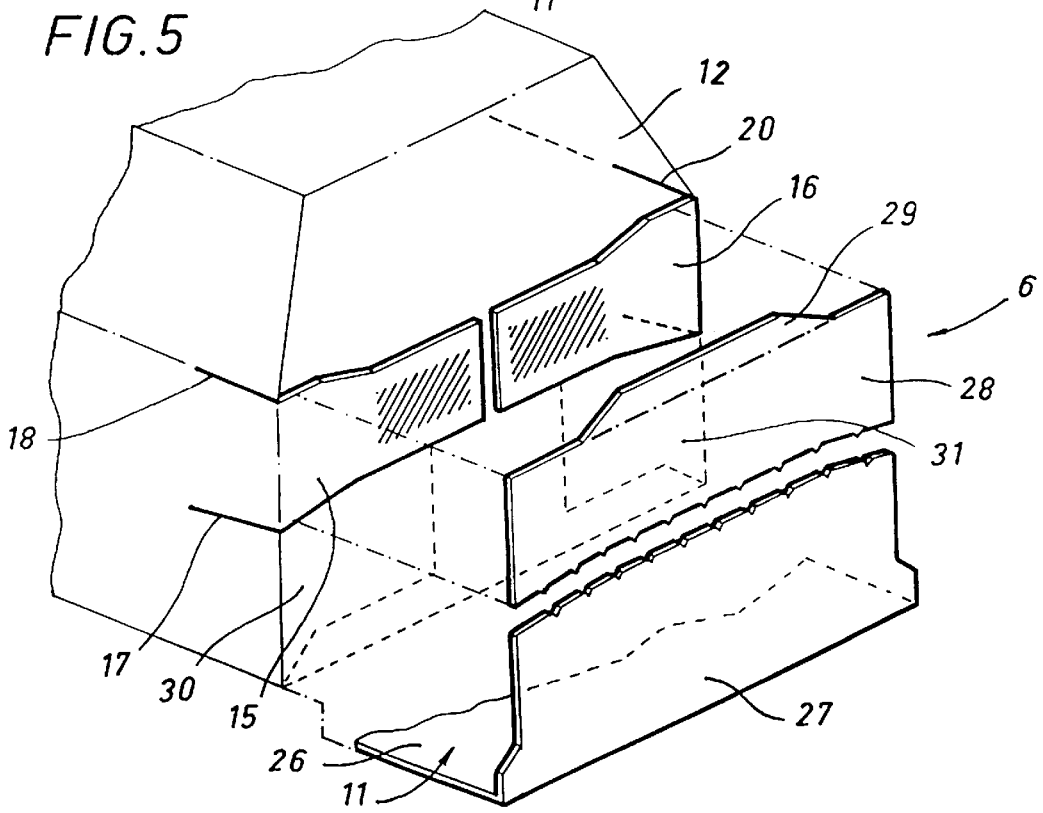
FIG. 5 is the same simplified view showing the identical structures, but dissociated.

FIG. 2 shows package 1 according to the invention in the storage state, with handle P integrated within the end surface, and in the carrying position with handle P disengaged and extended.

Package 1 according to the invention, which is parallelepiped, consists of a base 2, an upper surface 3, two lateral walls 4 and 5, and two end surfaces 6 and 7 within at least one of which, for example surface 6 called the rear surface, lateral handle P is integrated according to the invention.

Upper surface 3 resembles a double trap with two flaps 8 and 9 furnishing access to the bottles inside the package. A cutout/pop-up portion 10, precut and centered on upper portion 3, allows disengagement of access flaps 8 and 9, articulated around two fold lines.

Lateral walls 4 and 5 are each formed of two portions: a lower plane 4A and 5A, each perpendicular to the base, and an oblique upper plane 4B and 5B inclined toward the inside and converging toward the top when the package is assembled and positioned on base 2. The lower and upper planes of lateral walls 4 and 5 are separated by a scored line.

End surfaces 6 and 7 each consist of two folding panels, i.e. lower and upper panels, respectively, 11, 12 and 13, 14, which fold down in the extension of the base and the upper surface and close each end surface 6 and 7 in the conventional way. Thus, handle P of package 1 according to the invention originates partially from one of the end surface closing panels 6, for example, lower panel 11, as described in detail below.

Lateral walls 4 and 5 extend on one side into tongue-like strips 15 and 16 which fold down onto end surface 6 between two panels 11 and 12. These strips are long enough to connect at the center point of the handle and thus form the base layer of handle P. These strips 15 and 16 are located at the junction between the lower and upper portions of lateral walls 4 and 5, and extend into lower and upper slots 17, 18 and 19, 20, respectively, the former being located in the lower portion of lateral walls 4A and 5A, and the latter being located on the fold line of the lateral walls. These slots allow the ends of handle P to be flattened against the lateral surface of the adjacent contents in the corner of package 1 according to the invention, as described below.

Figure 3:
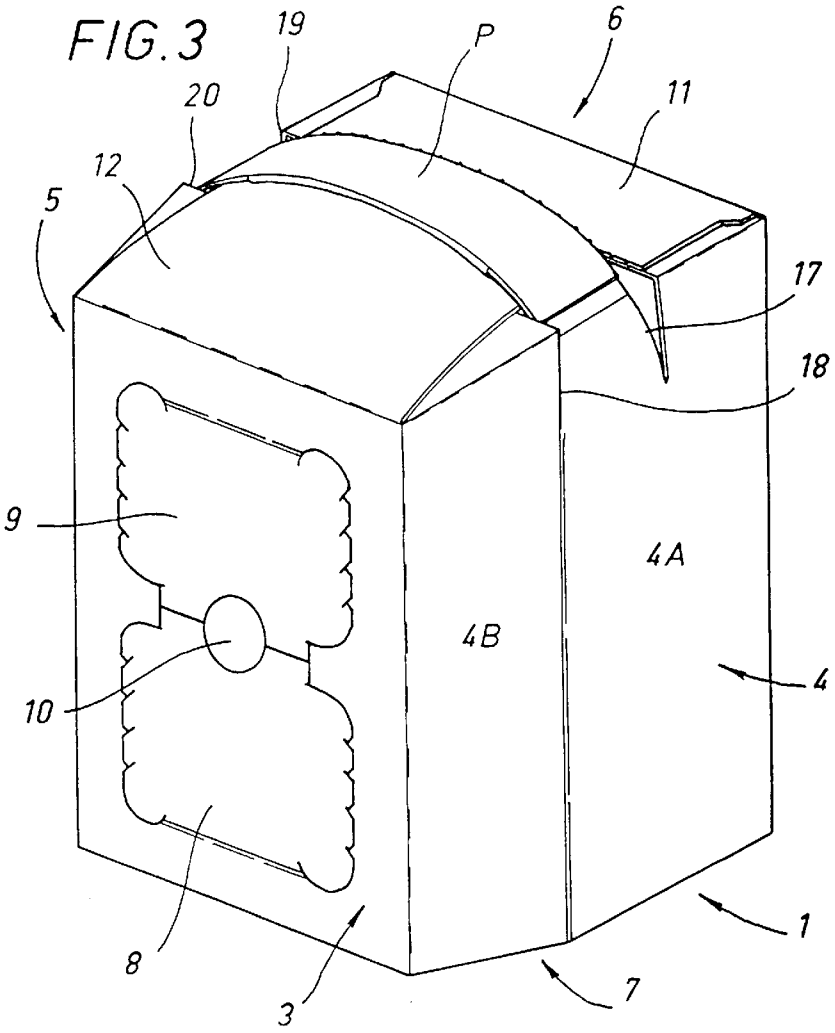
FIGS. 2 and 3 show a perspective of the package of the invention in its storage position as presented for sale, and ready to carry after the handle is formed, respectively.

As shown in FIG. 3, and FIG. 11 package 1 according to the invention is cut from a flat sheet of cardboard. The lower portion of lateral wall 5 extends into an assembly strip 21 which will be attached beneath base 2 during assembly.

End surface 6 of package 1, comprising integrated handle P, will be described in more detail below. It consists of two closing panels 11 and 12. The first panel 11 is the lower panel extending from base 2, which remains slightly detached, and the second panel 12 is the upper panel located in the extension of upper surface 3, articulated to the upper portions of lateral walls 4B and 5B by bellows-like connectors 22 and 23.

The opposite end surface 7 of package 1 also consists of two panels 13 and 14, the first panel 13 extending from base 2 and slightly detached from it, and the second panel 14 located in the extension of upper surface 3 and articulated to the upper portions of lateral walls 4B and 5B by identical connectors 24 and 25.

Lower closing panel 11 is composed of three parts. A first portion 26 extends from base 2 while remaining slightly detached. A second portion 27 defines a precut, detachable band 28 spanning entire width of panel 11 which will ultimately constitute handle P of package 1. The third portion consists of a flap 29 centered on the upper part of band 28, which folds inside to disengage handle P when package 1 is gripped and also reinforces the edge.

Package 1 of the invention is also provided with lateral closing flaps, two per extremity surface 30, 31, 32, and 33, respectively, located in the extension of the lower lateral wall portions, and which overlap to form the package in the conventional manner.

Positioning and assembling package 1 are accomplished with methods conventionally used for precut flat cardboard packaging.

Figure 7:
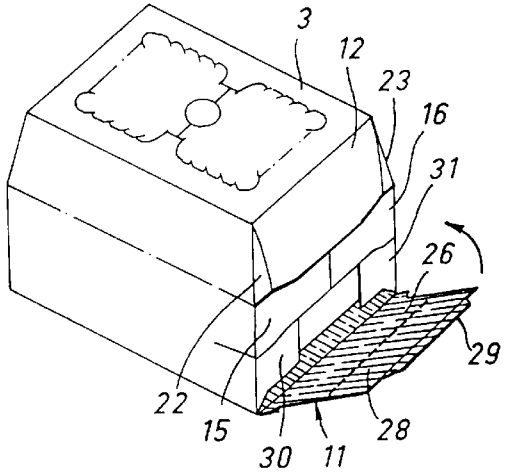
Figure 6:
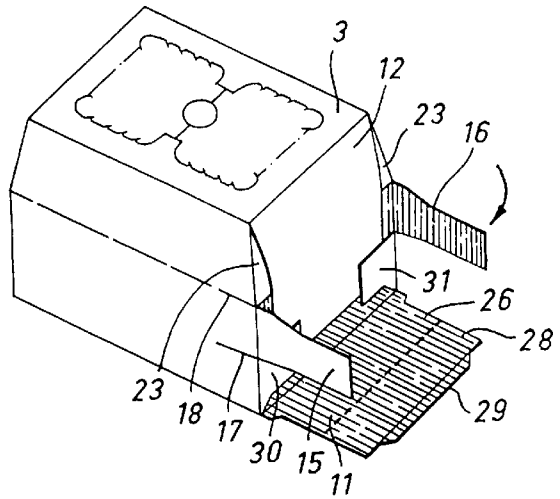
Figure 8:
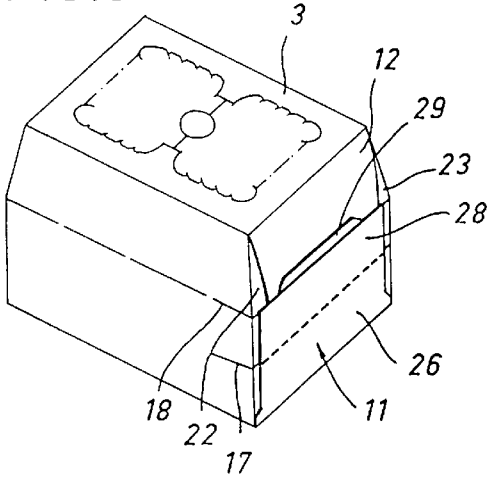

FIGS. 6 through 8 illustrate the main steps in closing end surface 6 which comprises handle P.

The basic step consists of surrounding the contents with the cutout sheet. After this operation, end surfaces 6 and 7 remain open, with the next step being to close these portions. The body of the package is formed into a pre-glued unit by gluing assembly strip 21 to base 2.

The next step consists of using a suitable mechanical means to fold down each upper panel 12 and 14; during the course of this operation, lateral connectors 22 through 25 are closed. As for extremity 6, interior lateral flaps 30 and 31, as well as end strips 15 and 16 forming handle P, are folded down next and covered by lower panel 11, which preferably has been previously glued in several places. Gluing takes place in the following areas: strips and lateral flaps and the median portion of the lower panel against the upper panel.

Upper panel 12 passes freely below the area with strips 15 and 16 covered by detachable band 28 on the upper portion of lower end panel 11, and it is only glued to said lower panel 11 at the lower extremity.

End flap 29 on lower panel 11 is not glued, which will allow handle P to be disengaged at the opportune time. Similarly, strips 15 and 16 are not glued to upper panel 12, but to the upper detachable portion 28 of lower panel 11 to form handle P.

Detachable band 28 of lower panel 11 is thus placed exactly below strips 15 and 16 and attached to them with glue, thus providing handle P with a double layer, making it more solid and rigid.

Figure 10:
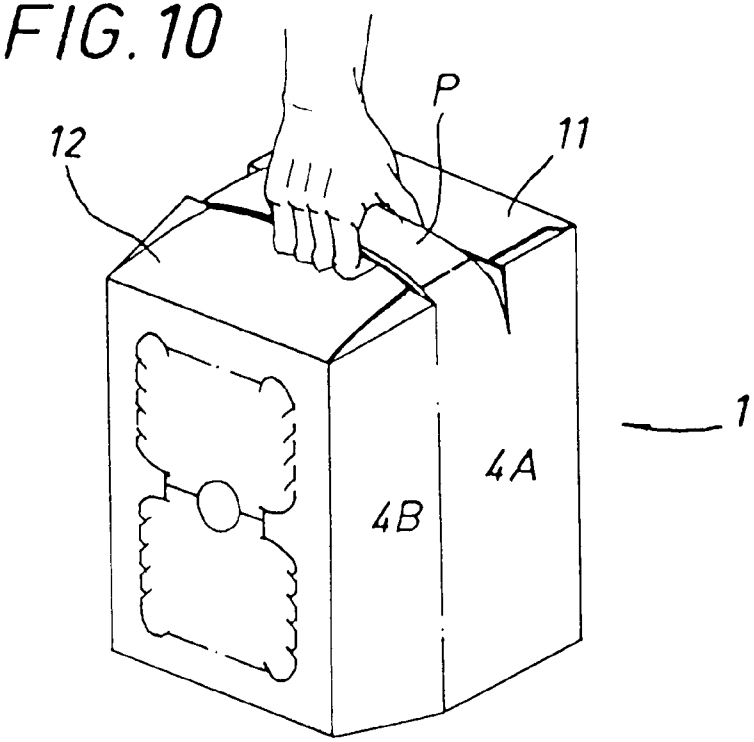
Figure 9:
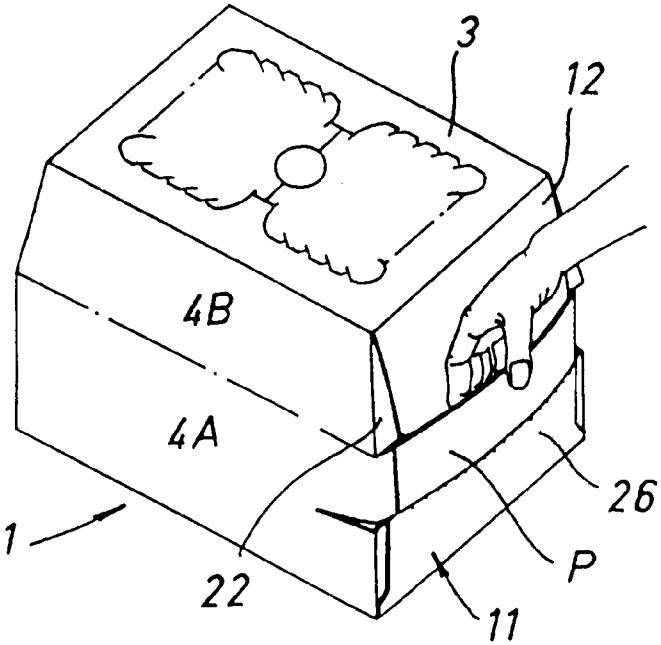

FIGS. 9 and 10 show how package 1 of the invention is grasped by handle P. Directions are provided on the end surface comprising handle P to guide the user in the following steps.

First, the purchaser must fold down flap 29 of lower panel 11 and place his or her hand between the end of this lower panel 11 and upper panel 12.

Pulling towards himself, the user then tears panel 11 along the perforated line incorporated during manufacture, thus activating a double thick band of cardboard which forms the body of handle P. The lower portion 25 of panel 11 remains glued to panel 12 and band 28 is joined to strips 15 and 16. The consumer has thus disengaged handle P consisting of strips 15 and 16 and central band 28 of panel 11 joined to the strips to connect and reinforce them.

In pulling, the user has created a space between the end surface 6 of the package and handle P. This space is easily formed without damaging the package because slots 17 through 20 are holding the ends of strips 15 and 16. These slots, several centimeters in size, allow handle P to curve appropriately, since the strips become flattened against the lateral surface of the adjacent containers in the corners of the package. In this way, there is enough space freed so the handle can be used to grip and carry the package.

After the handle is formed, however, note that the package remains completely closed. Actually, end surface 6 from which handle P was extracted is closed by upper panel 12 with lateral flaps 30 and 31 folded over it and lower portion 26 of panel 11 glued onto it.

The invention has been described with reference to the type of packaging known as a pre-glued carton or container. It is also applicable to packaging that is wrapped around an object.

What is claimed is:

1. A cardboard package, for a group of containers, formed from a flat sheet of material, the package comprising:

a base (2), a pair of lateral walls (4, 5) coupled to the base, an upper surface (3), located opposite from the base, coupled to the pair of lateral walls (4, 5) for providing access to an interior of the container;

opposed first and second end surfaces (6, 7), the first end surface (6) comprising first and second end panels (11, 12) being folded over one another to close the first end surface (6); and the second end surface (7) comprising first and second end panels (13, 14) being folded over one another to close the second end surface (7);

the base (2), the pair of lateral walls (4, 5), the upper surface (3) and the first and the second opposed end surfaces (6, 7) all forming the package for housing a plurality of containers therein;

a handle (P), integrated with the package, for facilitate grasping and carrying of the package, wherein the handle (P) is integral with the first end surface (6) and is partially formed by a detachable portion of the first end panel (11), the handle (P) further comprises a first extension from one of the pair of lateral walls (4, 5) and an second extension from the other of the pair of lateral walls (4, 5), and the detachable portion is secured to the first and second extensions of the pair of lateral walls (4, 5) whereby, when use of the handle (P) is desired, the detachable portion is disengaged from a remainder of the first end panel (11) to sufficiently space the handle (P) from the second end panel (12) and facilitate grasping and carrying of the package by a user, the second end panel (12) preserves the closed first end surface (6) and separates the handle (P) from the plurality of containers contained within the package.

2. The package according to claim 1, wherein the detachable portion is a precut, detachable band (28), and the extensions of the pair of lateral walls (4, 5) are two longitudinal, tongue-shaped strips (15, 16), the tongue-shaped strips are sandwiched between the first end panel (11) and the second end panel (12) of first end surface (6) and glued to a rear surface of the detachable band (28), which defines an extremity of the first end panel (11) of the first end surface (6), to form the lateral handle (P), and the handle (P) remains engaged with the first end panel (11) until grasped and pulled away by a user from the remainder of the first end panel (11) of the package to cause the extensions to become flattened, against adjacent lateral surfaces of the containers, and curve the handle (P) to facilitate grasping of the handle (P) by the user.

3. The package according to claim 2, wherein the two longitudinal, tongue-shaped strips (15, 16), forming the extensions, are partially defined a pair of slots (17, 18 and 19, 20) extending partially along each respective lateral wall (4, 5) on opposed side of the extensions.

4. The package according to claim 3, wherein the tongue-shaped strips (15, 16) are interconnected with one another via a detachable band (28) to form the handle (P).

5. The package according to claim 1, wherein the first end panel (11) of the first end surface (6) comprises a first portion (26), extending from the base (2) and being bendable about a common score line along the base (2), a second portion defining a precut band (28), and a third portion, centered on a top of the precut band (28), forming a flap (29) that can be folded around an edge of the handle (p) in order to engage the handle (P) when the package (1) is grasped by a user.

6. The package according to claim 1, wherein the detachable portion of the handle (P) is precut at an extremity of the first end panel (11), from the flat sheet of material, at the same time the package (1) is cut out.

7. The package according to claim 1, wherein each of the pair of lateral walls (4, 5) comprises a first vertical portion (4A, 5A) and a second vertical portion (4B, 5B) which each pair of lateral walls (4, 5) forms an oblique flap inclined toward an inside of the package when the package is assembled, and the first and second vertical portions are separated from one another by a scored line.

8. The package according to claim 7, wherein the first end panels (12, 14) of the first and second end surfaces (6, 7) are both formed as opposed extensions of the upper portion (3) and each of the first end panels (12, 14) is connected to the second vertical portions (4B, 5B) of both of the pair of lateral walls (4, 5) by articulated connectors (22, 23 and 24, 25).

9. A cardboard package, for a group of containers, formed from a flat sheet of material, the package comprising:

a base (2), a pair of lateral walls (4, 5) coupled to the base, an upper surface (3), located opposite from the base, coupled to the pair of lateral walls (4, 5) for providing access to an interior of the container;

opposed first and second end surfaces (6, 7), the first end surface (6) comprising first and second end panels (11, 12) being folded over one another to close the first end surface (6); and the second end surface (7) comprising first and second end panels (13, 14) being folded over one another to close the second end surface (7);

the base (2), the pair of lateral walls (4, 5), the upper surface (3) and the first and the second opposed end surfaces (6, 7) all forming the package for housing a plurality of containers therein;

a handle (P), integrated with the package, to facilitate grasping and carrying of the package, wherein the handle (P) is integral with one of the first end surface (6) and is partially formed by a detachable portion the first end panel (11), the handle (P) further comprises a first extension from one of the pair of lateral walls (4, 5) and a second extension from the other of the pair of lateral walls (4, 5), and the detachable portion is secured to the first and second extensions of the pair of lateral walls (4, 5) whereby, when use of the handle (P) is desired, the detachable portion is disengaged from a remainder of the first end panel (11) to sufficiently space the handle (P) from the second end panel (12) and facilitate grasping and carrying of the package by a user, the second end panel (12) preserves the closed first end surface (6) and separates the handle (P) from the plurality of containers contained within the package; and the detachable portion is a precut, detachable band (28), and the extensions of the pair of lateral walls (4, 5) are two longitudinal, tongue-shaped strips (15, 16), the tongue-shaped strips are sandwiched between the first end panel (11) and the second end panel (12) of the first end surface (6) and glued to a rear surface of the detachable band (28), which defines an extremity of the first end panel (11) of the first end surface (6), to form the lateral handle (P), and the handle (P) remains engaged with the first end panel (11) until grasped and pulled away by a user from the remainder of the first end panel (11) of the package to cause the extensions to become flattened, against adjacent lateral surfaces of the containers, and curve the handle (P) to facilitate grasping of the handle (P) by the user.

10. A method of forming a cardboard package from a flat blank for either pre-glueing or wrapping around a group of containers, the method comprising the steps of:

scoring and cutting the flat blank to define a base (2), an upper surface (3), lateral walls (4, 5), and two end surfaces (6, 7) comprising at least one upper panel (11, 13) and one lower panel (12,14) folded over each other to close the end surfaces (6, 7);

providing access to the containers via a removable opening in the upper surface (3), and forming a handle (P) integrated with the package for grasping and carrying the package, the handle (P) is an integral central portion of at least one of the end surfaces (6, 7) and comprises a detachable portion of one of the upper panels (11, 13) and the lower panels (12, 14), the detachable portion being attached to extensions of the lateral walls (4, 5);

freeing the handle (P) for use by disengaging the detachable portion from one of the upper panels and lower panels to space the handle from the at least one closed end surface (6, 7); and preserving the closed end surface (6, 7) of the package which integrates the handle (P) to separate the handle (P) from the containers after the handle (P) is freed for use.

* * * * *